US006474214B2

(12) United States Patent
Takeuchi et al.

(10) Patent No.: US 6,474,214 B2
(45) Date of Patent: Nov. 5, 2002

(54) THREE-POSITION STOP TYPE SWING ACTUATOR

(75) Inventors: Kiyoshi Takeuchi, Ibaraki (JP); Yoshihiro Takeda, Ibaraki (JP); Mitsunori Magaribuchi, Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/809,194

(22) Filed: Mar. 16, 2001

(65) Prior Publication Data

US 2001/0029835 A1 Oct. 18, 2001

(30) Foreign Application Priority Data

Apr. 12, 2000 (DE) ..... 2000-110672

(51) Int. Cl.[7] ..... F01B 31/14
(52) U.S. Cl. ..... 92/13.1; 92/33; 92/75
(58) Field of Search ..... 92/13.1, 13.4, 92/31, 33, 75

(56) References Cited

U.S. PATENT DOCUMENTS 3,141,387 A * 7/1964 Geyer ..... 92/33
3,610,107 A * 10/1971 Kawaguchi ..... 92/33
3,958,493 A * 5/1976 Fujita et al. ..... 92/13.1 X
5,067,323 A * 11/1991 Bennett et al. ..... 92/13.6 X
5,125,326 A * 6/1992 Sarcona ..... 92/75 X

* cited by examiner

*Primary Examiner*—John E. Ryznic
(74) *Attorney, Agent, or Firm*—Oblon, Spivak, McClelland, Maier & Neustadt, P.C.

(57) ABSTRACT

A three-position stop type swing actuator has a main piston freely moving in forward and backward directions in an axial direction within a casing, an output shaft placed at a coaxial position with the main piston in such a manner as to be fixed in an axial direction and freely rotate around an axis, a conversion and transmission mechanism converting a forward and backward motion of the main piston into a rotating and swinging motion of the output shaft, and a sub piston having a stroke smaller than that of the main piston a fluid pressure operating force larger than that of the main piston and arranged within the casing in such a manner as to freely move in the forward and backward directions and be capable of being brought into contact with the main piston so as to restrict a middle stop position of the main piston.

21 Claims, 6 Drawing Sheets

THREE-POSITION STOP TYPE SWING ACTUATOR

TECHNICAL FIELD

The present invention relates to a swing actuator converting a forward and backward motion of a piston into a rotating and swinging motion of an output shaft coaxially positioned with the piston so as to output, and more particularly to a three-position stop type swing actuator which can stop the output shaft at a middle position of the rotation and swing.

PRIOR ART

In this kind of swing actuator rotating and swinging the output shaft, there is a case that it is required to stop the output shaft at the middle position of the rotation and swing.

On the contrary, the swing actuator which can stop the output shaft at the middle position of the rotation and swing can be realized, as shown in FIGS. 7 and 8, for example, by providing with a cylinder for a middle stop 3 having a large propelling force for stopping a rack at a moving middle position in a body of a rack and pinion type swing actuator 1.

The rack and pinion type swing actuator 1 is not particularly illustrated since a structure of itself has been already well-known, however, is structured such that a rack moving in forward and backward directions due to a fluid pressure and a pinion engaging with the rack are provided in an inner portion of the body 2, and an output shaft 4 rotating and swinging by the pinion is provided in a direction perpendicular to a moving direction of the rack.

On the contrary, the middle stop cylinder 3 has a piston having a larger propelling force than the rack, and the rack moved along a full stroke because the rack is not restricted by the piston when the piston is retracted, whereby the output shaft swings all around an angular range. Further, when the piston moves forward, the rack is brought into contact with the piston so as to restrict the stroke, so that the swing angle of the output shaft is limited.

In FIGS. 7 and 8, reference symbols 6*a* and 6*b* denote supply and discharge ports for supplying and discharging a compressed air to both ends in an axial direction of the rack, reference symbols 7*a* and 7*b* denote supply and discharge ports for supplying and discharging the compressed air to both ends of the piston of the middle stop cylinder 3, and reference numeral denotes a position detecting sensor for detecting moving positions of the rack and the piston.

As mentioned above, the swing actuator which can stop the output shaft at the middle position of the rotation and swing can be realized by providing with the middle stop cylinder in the rack and pinion type swing actuator, however, since the rack and pinion type actuator is structured such that an axis of the output shaft and an axis of the rack vertically cross to each other, a size in a direction perpendicular to the axis of the output shaft is increased.

DISCLOSURE OF THE INVENTION

An object of the present invention is to obtain a three-position stop type swing actuator having a small size in a direction perpendicular to an axis of an output shaft and a comparatively simple structure.

In order to achieve the object mentioned above, in accordance with the present invention, there is provided a three-position stop type swing actuator comprising: a main piston arranged within a casing in such a manner as to freely move in forward and backward directions due to a fluid pressure; an output shaft placed at a coaxial position with the main piston in such a manner as to be fixed in an axial direction and freely rotate around an axis; a conversion and transmission mechanism converting a forward and backward motion of the main piston into a rotating and swinging motion of the output shaft so as to transmit to the output shaft; and a sub piston arranged within the casing in such a manner as to freely move in the forward and backward directions due to the fluid pressure and be capable of being brought into contact with the main piston.

Further, in accordance with the present invention, there is provided a three-position stop type swing actuator comprising: a first cylinder hole provided within a casing in such a manner as to be communicated with each other, and having a small diameter and a large length in an axial direction; a second cylinder hole having a large diameter and a short length in an axial direction; a main piston arranged within the first cylinder hole in such a manner as to freely move in forward and backward directions in an axial direction; a sub piston having a large diameter portion sliding in an airtight manner within the second cylinder hole and a small diameter portion sliding in an airtight manner within the first cylinder hole, and restricting a middle stop position of the main piston by the small diameter portion being brought into contact with the main piston; a first pressure chamber formed in one end surface side of the main piston; a second pressure chamber formed between another end surface of the main piston and a small diameter portion of the sub piston; a third pressure chamber formed in a side of a large diameter portion of the sub piston; an output shaft placed at a coaxial position with the main piston in the casing in such a manner as to be fixed in an axial direction and freely rotate around an axis; and a conversion and transmission mechanism converting a forward and backward motion of the main piston into a rotating and swinging motion of the output shaft so as to transmit to the output shaft.

In the swing actuator having the structure mentioned above, when driving the main piston in a state of forward moving the sub piston, the main piston is brought into contact with the sub piston so as to stop at the middle position, so that the output shaft also rotates and swings in a limited manner at a corresponding angle. When backward moving the sub piston, the main piston moves together and reaches a predetermined stroke end, and the output shaft rotates and swings to a predetermined angular range in correspondence thereto.

As mentioned above, in accordance with the present invention, it is possible to convert the forward and backward motion of the main piston into the rotating and swinging motion of the output shaft arranged at the coaxial position with the main piston so as to output, so that it is possible to make the size in the direction perpendicular to the axis of the output shaft small in comparison with the rack and pinion type actuator.

In accordance with one embodiment of the present invention, the swing actuator has an adjuster for changing the middle stop position of the main piston by adjusting the stroke of the sub piston. The adjuster is constituted by a bolt, has an outer end portion for an adjusting operation protruding outward from the casing and an inner end portion fitted to an inner portion of the sub piston in such a manner as to freely slide relatively and is provided with an engaging portion engaging with the sub piston in the inner end portion.

In accordance with a particular embodiment of the present invention, the conversion and transmission mechanism includes at least one of first converting means converting a forward and backward motion of the main piston into a rotating and swinging motion of the main piston and second converting means converting the forward and backward motion of the main piston into the rotating and swinging motion of the output shaft.

The first converting means is constituted by a spiral groove formed on an outer periphery of the main piston and a pin fitted to the casing so as to best fitted to the spiral groove, and the second converting means is constituted by a spiral groove formed on an outer periphery of the output shaft and a pin fixed to the main piston so as to be fitted to the spiral groove.

The second converting means may be constituted by a screw having a lead angle larger than 45 degrees and formed on the outer periphery of the output shaft, and a nut formed in the main piston and meshed with the screw, in place of the spiral groove and the pin.

DETAILED DESCRIPTION

Figure 1:
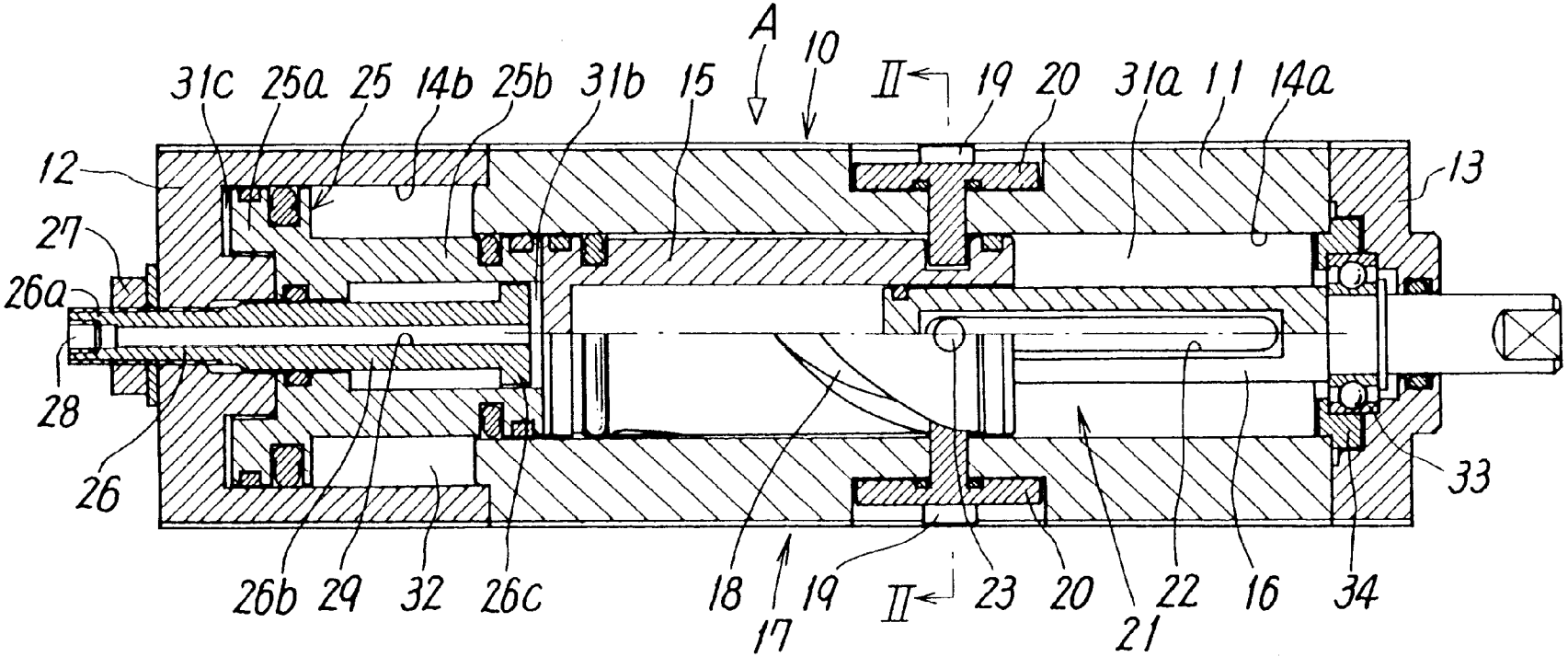
FIG. 1 is a vertical cross sectional front elevational view of a first embodiment in accordance with the present invention.
Figure 2:
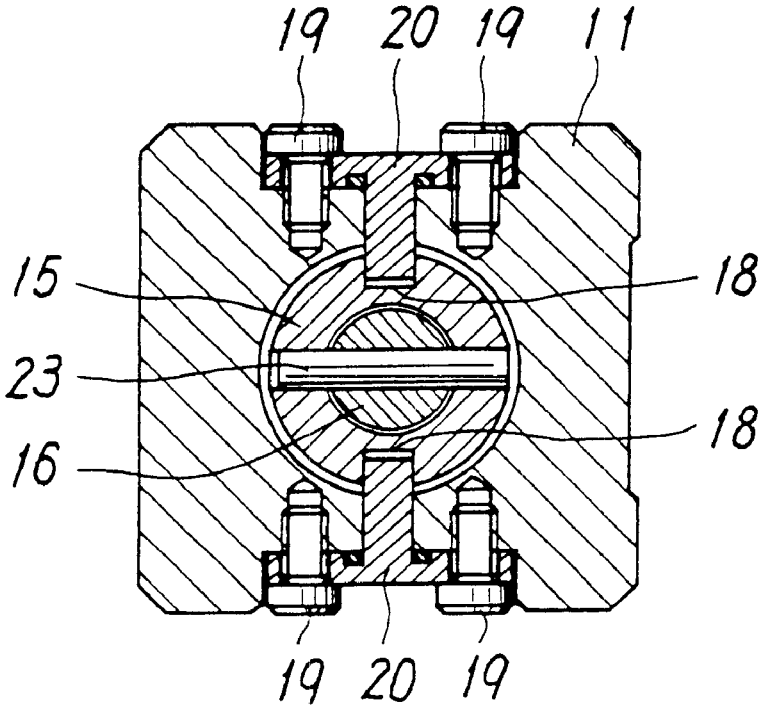
FIG. 2 is a cross sectional view along a line II—II in FIG. 1.

FIGS. 1 to 4 show a first embodiment of a swing actuator in accordance with the present invention. The swing actuator A has a casing 10. The casing 10 is constituted by a main body portion 11 positioned in a center portion, a head cover 12 mounted at both ends in an axial direction thereof in an airtight manner and a rod cover 13, and a first cylinder hole 14*a* positioned within the main body portion 11 and having a small diameter and a large length in an axial direction and a second cylinder hole 14*b* positioned within the head cover 12 and having a large diameter and a short length in an axial direction are provided in an inner portion of the casing 10.

A main piston 15 is received within the first cylinder hole 14*a* in such a manner as to freely move in forward and backward directions in an axial direction, and a sub piston 25 is received within the second cylinder hole 14*b* in such a manner as to freely move in forward and backward directions in an axial direction. The main piston 15 is formed so that pressure receiving areas on both end surfaces are equal to each other. Further, the sub piston 25 has a large diameter portion 25*a* sliding within the second cylinder hole 14*b* in an airtight manner and a hollow small diameter portion 25*b* sliding within the first cylinder hole 14*a* in an airtight manner, and is structured such as to restrict a middle stop position of the main piston 15 by the small diameter portion 25*b* being brought into contact with the main piston 15. The pressure receiving area of the small diameter portion 25*b* in the sub piston 25 is formed so as to be equal to the pressure receiving area of both end surfaces of the main piston 15, and the pressure receiving area of the large diameter portion 25*a* is formed so as to be larger than the above. Accordingly, the sub piston 25 has a stroke smaller than that of the main piston 15 and a great propelling force in one direction by the large diameter portion 25*a*.

A first pressure chamber 31*a* is formed between the main piston 15 and the rod cover 13, a second pressure chamber 31*b* is formed between another end surface of the main piston 15 and the small diameter portion 25*b* of the sub piston 25, and a third pressure chamber 31*c* is formed between the large diameter portion 25*a* of the sub piston 25 and the head cover 12. Further, the first pressure chamber 31*a* and the third pressure chamber 31*c* are respectively connected to ports (not shown) provided in the casing 10, and the second pressure chamber 31*b* is connected to a port 28 formed in an adjuster 26 which is in detail described later, through a flow passage 29. Further, a breathing chamber 32 in a back surface side of the large diameter portion 25*a* of the sub piston 25 is released to the open air through a breathing port (not shown).

Figure 4:
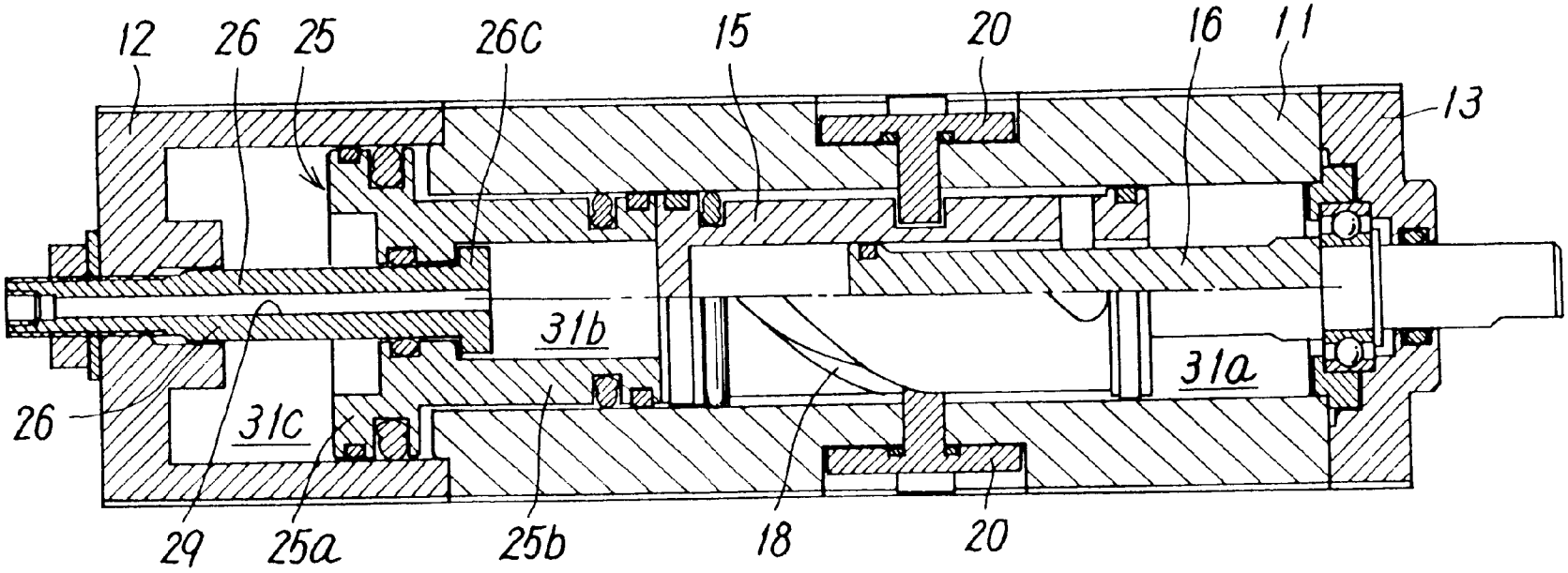
FIG. 4 is a cross sectional view showing a middle stop state of the first embodiment.

Accordingly, the main piston 15 forward and backward moves within the first cylinder hole 14*a* at a full stroke by alternately supplying a pressure fluid to the first pressure chamber 31*a* and the second pressure chamber 31*b* in a state retracting the sub piston 25 as shown in FIG. 1 by releasing the third pressure chamber 31*c* to the external portion. Further, when making the sub piston 25 in a forward moving state as shown in FIG. 4 by supplying the pressure fluid to the third pressure chamber 31*c*, one stroke end of the main piston 15 is restricted by the sub piston 25, so that a stroke of the main piston 15 becomes short. Further, when releasing the third pressure chamber 31*c* from a state that the main piston 15 is brought into contact with the sub piston 25 so as to middle stop, the main piston 15 further moves to a full stroke end together with the sub piston 25.

An output shaft 16 is placed at a coaxial position with the main piston 15 in the rod cover 13 in the casing 10 in a state of protruding a front end portion outward from the rod cover 13 and inserting a base end portion into an inner hole of the main piston 15 in a relatively slidable manner, in such a manner as to be fixed in an axial direction and freely rotate around an axis. Further, a conversion and transmission mechanism for converting a forward and backward motion of the main piston 15 into a rotating and swinging motion of the output shaft 16 so as to transmit to the output shaft 16 is provided in the casing 10, the main piston 15 and the output shaft 16.

The conversion and transmission mechanism is provided with first converting means 17 converting the forward and backward motion of the main piston 15 into the rotating and swinging motion of the main piston 15, and connecting means 21 engaging the main piston 15 and the output shaft 16 with each other in a rotational direction and connecting them so as to freely move relatively in an axial direction.

The first converting means 17 is constituted by a plurality of spiral grooves 18 formed on an outer periphery of the main piston 15, and a plurality of pins 20 fixed to a side surface of the casing 10 by bolts 19, having front ends protruding to an inner portion of the casing 10 and fitted so that the front ends freely move within the spiral groove 18 relatively. Further, the structure is made such that the pins 20 relatively move within the spiral groove 18 in accordance with the forward and backward motion of the main piston 15, whereby the main piston 15 rotates around the axis. It is desirable that the spiral groove 18 has a lead angle larger than 45 degrees.

On the contrary, the connecting means 21 is constituted by an oblong hole 22 formed on the side surface of the output shaft 16 in an axial direction, and a pin 23 mounted to the main piston 15 and movably fitted to the oblong hole 22. In this case, the oblong hole 22 is formed so as to extend through the output shaft 16 in a diametrical direction, the pin 23 may extend through the oblong hole 22 or the structure may be made such that two groove-shaped oblong holes are individually formed in both right and left side surfaces of the output shaft 16, and two pins are individually fitted to the oblong holes.

In order to make it possible to change the middle stop position of the main piston 15 by adjusting the stroke of the sub piston 25, the adjuster 26 is provided in the head cover 12. The adjuster 26 is constituted by a bolt, has an outer end portion 26*a* for an adjusting operation protruding outward from the head cover 12, and an inner end portion 26*b* fitted into an inner hole of the small diameter portion 25*b* of the sub piston 25 in such a manner as to freely slide relatively, and is provided with an engaging portion 26*c* engaging with the sub piston 25 in the inner end portion 26*b*. A screwed portion is formed in the outer end portion 26*a*, a lock nut 27 for fixing is screwed therewith, and the structure is made such that a position of the bolt 26, that is, a position of the engaging portion 26*c* can be adjusted by loosening the lock nut 27, whereby the stroke of the sub piston 25 can be changed. Further, an end surface of the inner end portion 26*b* of the adjuster 26 faces within the second pressure chamber 31*b*.

In this case, reference numeral 33 in FIG. 1 denotes a ball bearing supporting the output shaft 16, and reference numeral 34 denotes a damper.

Next, a description will be given of an operation of the swing actuator.

FIG. 1 shows a state that both of the main piston 15 and the sub piston 25 are in a backward end.

Figure 3:
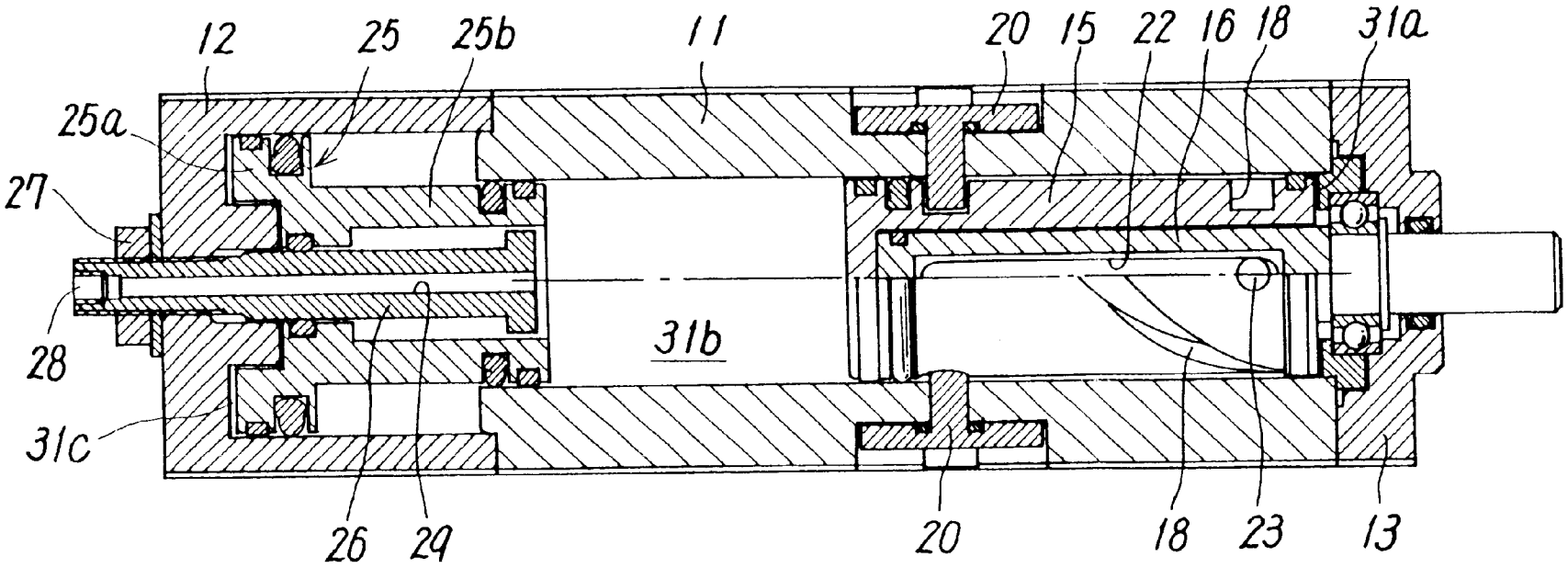
FIG. 3 is a cross sectional view showing a different operating state of the first embodiment.

In this state, when supplying the compressed air to the second pressure chamber 31*b* from a flow passage 29 within the adjuster 26 and discharging the air within the first pressure chamber 31*a* outward, the main piston 15 forward moves to a position in a forward end shown in FIG. 3 at a full stroke while rotating around the axis due to an operation between the spiral groove 18 and the pin 20. Then, the rotation of the main piston 15 is transmitted to the output shaft 16 via the pin 23, and the output shaft 16 rotates around the axis at that position at a preset angle.

Further, when supplying the compressed air to the first pressure chamber 31*a* from the state shown in FIG. 3 and discharging the air within the second pressure chamber 31*b* outward, the main piston 15 backward moves in a left direction in the drawing while rotating in an opposite direction to that of the case mentioned above, whereby the output shaft 16 rotates in a opposite direction to the direction mentioned above.

On the contrary, in the state shown in FIG. 1, when supplying the compressed air to the third pressure chamber 31*c* and the first pressure chamber 31*a*, the sub piston 25 and the main piston 15 integrally move forward in a right direction in the drawing because a pressure receiving area of the large diameter portion 25*a* of the sub piston 25 is larger than a pressure receiving area of the main piston 15, whereby the sub piston 25 stops at a position engaging with the engaging portion 26*c* of the adjuster 26, as shown in FIG. 4. At this time, the output shaft 16 also stops at a middle rotational position.

When discharging the compressed air in the first pressure chamber 31*a* at the same time of supplying the compressed air to the second pressure chamber 31*b* in this state, the main piston 15 moves to the forward end and the output shaft 16 further rotates in accordance with the movement thereof.

Further, when discharging the compressed air in the second pressure chamber 31*b* and supplying the compressed air to the first pressure chamber 31*a* in a state that the main piston 15 moves to the forward end at the right end in the manner mentioned above, the main piston 15 backward moves to the position being brought into contact with the sub piston 25 and temporarily stops at the position. When discharging the compressed air in the third pressure chamber 31*c* to the external portion thereafter, the main piston 15 and the sub piston 25 are integrally returned to the position at the rear end shown in FIG. 1 due to the operating force of the compressed air supplied to the first pressure chamber 31*a*, so that the output shaft 16 rotates at a predetermined angle in accordance with the movement of the main piston 15.

As mentioned above, the output shaft 16 can be stopped at the rotational middle stop position, however, the rotational middle stop position can be adjusted by backward moving the adjuster 26 with respect to the head cover 12 so as to adjust the stop position of the sub piston 25.

In the swing actuator A having the structure mentioned above, since the output shaft 16 is arranged at the coaxial position with the main piston 15, it is possible to make the actuator slim and compact in comparison with the structure in which the output shaft is protruded in vertical to the axis of the rack, such as the rack and pinion type swing actuator.

Further, since no gear mechanism such as a rack and pinion or the like is employed, it is possible to make the structure simple and inexpensive.

Figure 5:
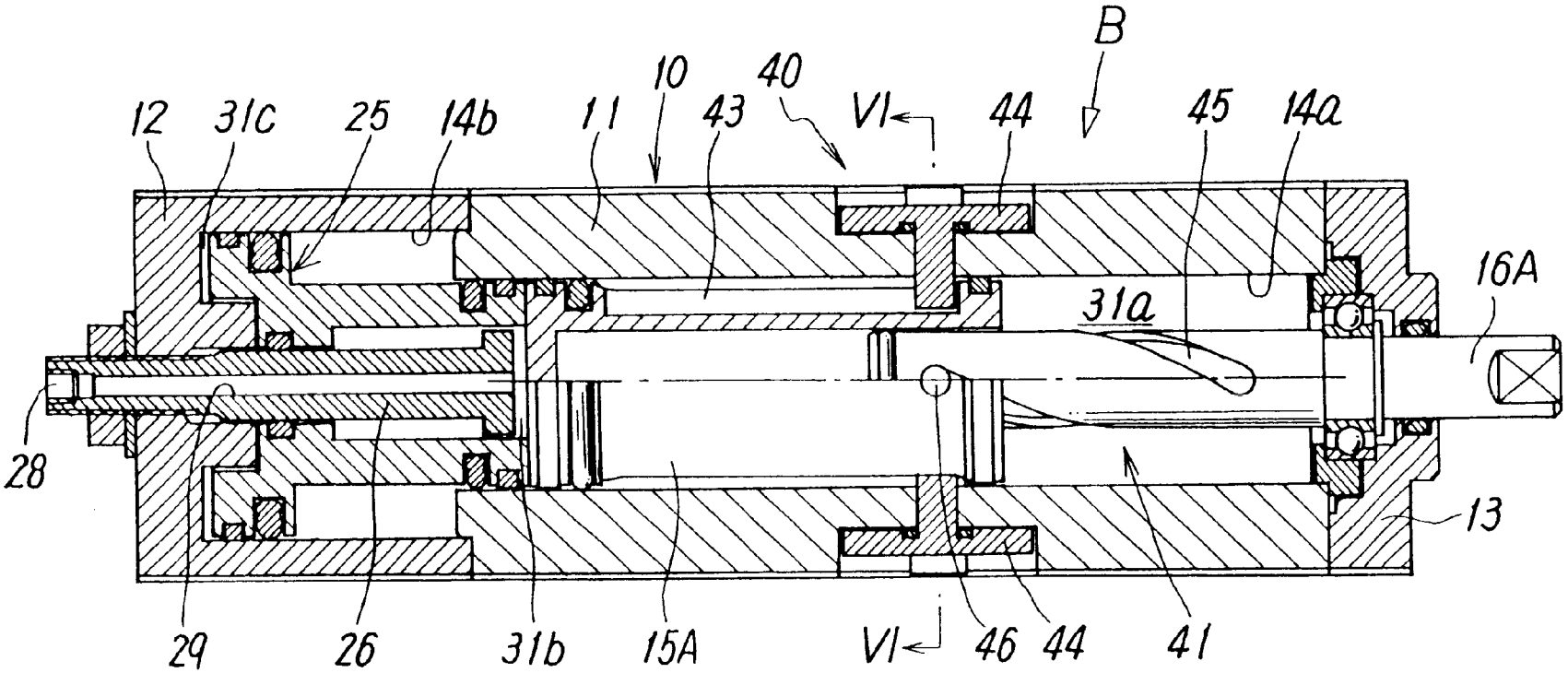
FIG. 5 is a vertical cross sectional front elevational view of a second embodiment in accordance with the present invention.
Figure 6:
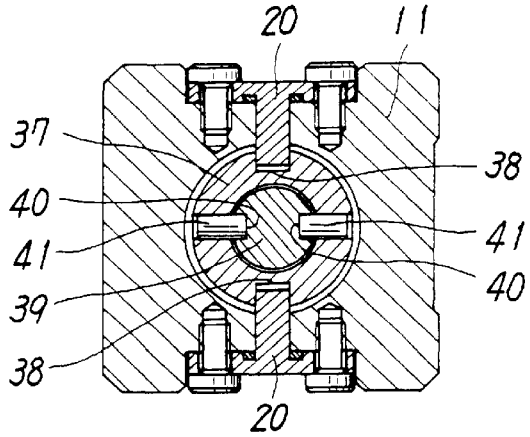
FIG. 6 is a cross sectional view along a line VI—VI in FIG. 5.
Figure 7:
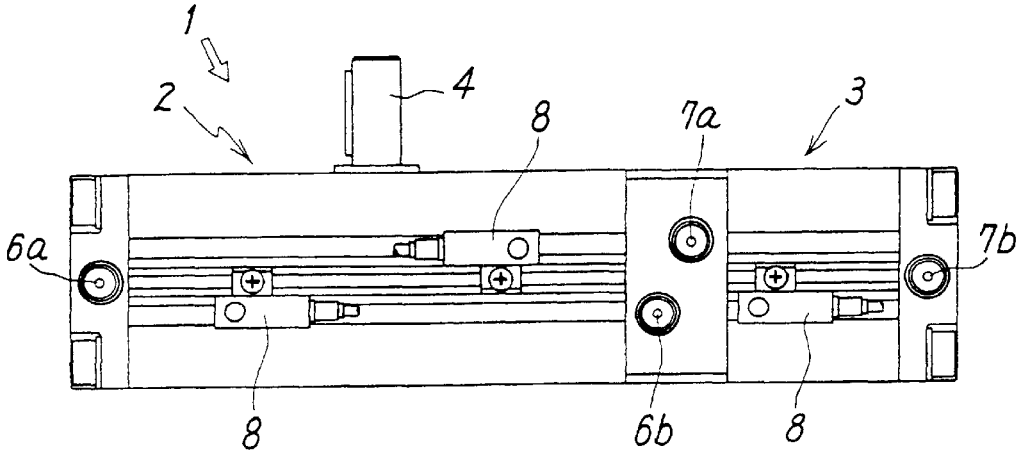
FIG. 7 is a front elevational view of a conventional embodiment.
Figure 8:
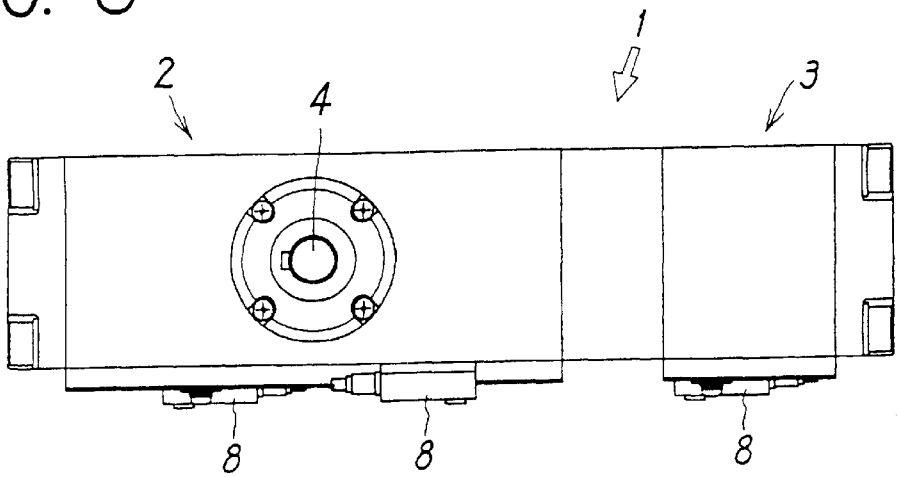
FIG. 8 is a plan view of the same conventional embodiment.

FIGS. 5 and 6 show a second embodiment in accordance with the present invention. A swing actuator B of the second embodiment is different from the first embodiment in the following point. That is, in the first embodiment, the structure is made such that the forward and backward motion of the main piston 15 is temporarily converted into the rotating and swinging motion of the main piston 15 by the first converting means 17 and the rotating and swinging motion is transmitted to the output shaft 16 by the connecting means 21, however, on the contrary, in the second embodiment, the structure is made such that a rotation preventing mechanism 40 is provided between a main piston 15A and the casing 10, whereby the main piston 15A only performs a linear forward and backward motion and the linear motion of the main piston 15A is converted into a rotating and swinging motion of an output shaft 16A by a second converting means 41.

The rotation preventing means 40 is constituted by a plurality of grooves 43 formed on an outer side surface of the main piston 15A in an axial direction, and a plurality of pins 44 fixed to the casing 10 and fitted to the respective grooves 43 so that front ends thereof freely move, so that a rotation of the main piston 15A is prevented by an engagement between the grooves 43 and the pins 44.

On the contrary, the second converting means 41 is formed by a plurality of spiral grooves 45 formed on an outer peripheral surface of the output shaft 16A and a plurality of pins 46 fixed to the main piston 15A and fitted to the respective spiral grooves 45, and is structured such that the forward and backward motion of the main piston 15A is converted into the rotating motion of the output shaft 16A by the pins 46 and the spiral groove 45, and the output shaft 16A swings and rotates around the axis thereof.

Since the other structures and operations of the second embodiment are substantially the same as those of the first embodiment, the same reference numerals are attached to the same main elements as those of the first embodiment, and a description thereof will be omitted.

Further, although an illustration is omitted, it is possible to simultaneously provide with both of the first converting means in the first embodiment and the second converting means 41 in the second embodiment in the case of converting the forward and backward motion of the main piston into the rotating and swinging motion of the output shaft. That is, the structure can be made such that a plurality of spiral grooves 18 are formed on the outer peripheral surface of the main piston and a plurality of pins 20 fitted to the respective spiral grooves 18 are provided in the casing, as the first converting means 17 in the first embodiment, and a plurality of spiral grooves 45 are formed on the outer peripheral surface of the output shaft and a plurality of pins 46 fitted to the respective spiral grooves 45 are provided in the main piston, as the second converting means 41 in the second embodiment. In this case, by making the directions of the spiral grooves 18 and 45 in the first converting means 17 and the second converting means 41 inverse to each other, it is possible to increase the angular range of the rotation and the swing of the output shaft by the same stroke of the main piston as that of the case of the first and second embodiments.

In this case, in each of the embodiments mentioned above, the spiral grooves and the pins are employed as the converting means for converting the linear motion into the rotating and swinging motion, however, it is possible to employ a screw having a lead angle larger than 45 degrees and a nut meshed with the screw. In a particular embodiment, for example, the second converting means 41 may be constituted by a screw formed on an outer periphery of the output shaft and a nut formed in an inner hole of the main piston and meshed with the screw, in place of the spiral groove 45 and the pin 46. It is a matter of course that the screw in this case includes a ball screw.

Further, in each of the embodiments, the guide mechanism for linearly moving the main piston with respect to the casing or the output shaft is constituted by the oblong hole 22 formed in the output shaft 16 and the pin 23 provided in the main piston 15 in the first embodiment, and constituted by the groove 43 formed in the main piston 15A and the pin 44 provided in the casing 10 in the second embodiment, however, a spline may be employed in place thereof.

What is claimed is:

1. A three-position stop type swing actuator comprising:

a casing having a first cylinder hole and a second cylinder hole therein, said first cylinder hole having a smaller diameter and a lager length in an axial direction of said casing than said second cylinder hole;

a main piston disposed in said first cylinder hole to move in forward and backward directions in the axial direction;

a sub piston having a large diameter portion configured to slide in an airtight manner within said second cylinder hole and a small diameter portion configured to slide in an airtight manner within said first cylinder hole, said sub piston being configured to move said main piston less than a full stroke of said main piston in the forward direction;

an output shaft coaxially connected to said main piston in such a manner as to rotate around an axis of said output shaft; and a conversion and transmission mechanism configured to convert a forward and backward motion of said main piston into a rotating and swinging motion of said output shaft;

wherein said casing provides a first pressure chamber on one end surface side of said main piston, a second pressure chamber between an opposite end surface of said main piston and the small diameter portion of said sub piston, and a third pressure chamber on a side of the large diameter portion of said sub piston.

2. A swing actuator according to claim 1, further comprising an adjusting device configured to adjust the stroke of said sub piston to change a stroke of said main piston driven by said sub piston.

3. A swing actuator as claimed in claim 2, wherein said adjusting device has an outer end portion protruding outward from said casing, an inner end portion slidably fitted to an inner portion of said sub piston, an engaging portion configured to engage with said sub piston, and a communicating passage for applying the fluid pressure to said main piston.

4. A swing actuator according to claim 1, wherein said conversion and transmission mechanism includes at least one of first converting means converting a forward and backward motion of said main piston into a rotating and swinging motion of said main piston and second converting means converting the forward and backward motion of said main piston into the rotating and swinging motion of said output shaft.

5. A swing actuator according to claim 4, wherein said first converting means comprises at least one spiral groove formed on an outer periphery of said main piston and at least one pin fitted to said at least one spiral groove, and said second converting means comprises at least one spiral groove formed on an outer periphery of said output shaft and at least one pin provided to said main piston so as to be fitted to said at least one spiral groove.

6. A swing actuator according to claim 4, wherein said second converting means comprises a screw having a lead angle larger than 45 degrees and formed on the outer periphery of said output shaft, and a nut formed in the main piston and meshed with the screw.

7. A three-position stop type swing actuator comprising:

a casing;

a main piston disposed in the casing to move in forward and backward directions due to a fluid pressure;

an output shaft connected coaxially with said main piston and configured to rotate around an axis of the output shaft;

a converting mechanism configured to convert a forward and backward motion of said main piston into a rotating and swinging motion of said output shaft; and a sub piston disposed in said casing to move said main piston less than a full stroke of said main piston in the forward direction;

wherein:

said converting mechanism comprises one of a first converting device configure to convert the forward and backward motion of said main piston into a rotating and swinging motion of the main piston and a second converting device configured to convert the forward and backward motion of said main piston into the rotating and swinging motion of said output shaft;

said first converting device comprises at least one spiral groove formed on an outer periphery of said main piston and at least one pin fitted to said casing so as to be fitted to said at least one spiral groove; and said second converting device comprises one of a spiral groove formed on an outer periphery of said output shaft fitted with a pin fixed to said main piston and a screw with a lead angle larger than 45 degrees formed on the outer periphery of said output shaft meshed with a nut formed in the main piston.

8. A swing actuator according to claim 7, wherein said sub piston is configured to receive a larger fluid pressure than said main piston and has a smaller stroke than said main piston.

9. A swing actuator according to claim 7, further comprising an adjusting device configured to adjust the stroke of said sub piston to change a stroke of said main piston driven by said sub piston.

10. A swing actuator according to claim 9, wherein said adjusting device has an outer end portion protruding outward from said casing, an inner end portion slidably fitted to an inner portion of said sub piston, and an engaging portion configured to engage with said sub piston.

11. A swing actuator according to claim 9, wherein said adjusting device has a communicating passage for applying the fluid pressure to said main piston.

12. A three-position stop type swing actuator comprising:

a first cylinder hole provided within a casing in such a manner as to be communicated with each other, and having a small diameter and a large length in an axial direction;

a second cylinder hole having a large diameter and a short length in an axial direction;

a main piston arranged within said first cylinder hole in such a manner as to freely move in forward and backward directions in an axial direction;

a sub piston having a large diameter portion sliding in an airtight manner within said second cylinder hole, and a small diameter portion sliding in an airtight manner within said first cylinder hole, and restricting a middle stop position of said main piston by said small diameter portion being brought into contact with said main piston;

a first pressure chamber formed in one end surface side of said main piston;

a second pressure chamber formed between another end surface of said main piston and a small diameter portion of said sub piston;

a third pressure chamber formed in a side of a large diameter portion of said sub piston;

an output shaft placed at a coaxial position with said main piston in said casing in such a manner as to be fixed in an axial direction and freely rotate around an axis; and a conversion and transmission mechanism converting a forward and backward motion of said main piston into a rotating and swinging motion of said output shaft so as to transmit to said output shaft.

13. A swing actuator according to claim 12, wherein said swing actuator has an adjuster for changing the middle stop position of said main piston by adjusting the stroke of said sub piston, and the adjuster is constituted by a bolt, has an outer end portion for an adjusting operation protruding outward from said casing and an inner end portion fitted to an inner portion of said sub piston in such a manner as to freely slide relatively and is provided with an engaging portion engaging with said sub piston in said inner end portion.

14. A swing actuator as claimed in claim 13, wherein said adjuster has a port in said outer end portion and is placed so that said inner end portion faces within said second pressure chamber, and a communicating passage connecting said port to said second pressure chamber is provided within said adjuster.

15. A swing actuator according to claim 12, wherein said conversion and transmission mechanism includes at least one of first converting means converting a forward and backward motion of said main piston into a rotating and swinging motion of said main piston and second converting means converting the forward and backward motion of said main piston into the rotating and swinging motion of said output shaft.

16. A swing actuator according to claim 15, wherein said first converting means is constituted by a spiral groove formed on an outer periphery of said main piston and a pin fitted to said casing so as to be fitted to said spiral groove, and said second converting means is constituted by a spiral groove formed on an outer periphery of said output shaft and a pin fixed to said main piston so as to be fitted to said spiral groove.

17. A swing actuator according to claim 15, wherein said second converting means may be constituted by a screw having a lead angle larger than 45 degrees and formed on the outer periphery of said output shaft, and a nut formed in the main piston and meshed with the screw.

18. A three-position stop type swing actuator comprising:

a main piston arranged within a casing in such a manner as to freely move in forward and backward directions due to a fluid pressure;

an output shaft placed at a coaxial position with said main piston in such a manner as to be fixed in an axial direction and freely rotate around an axis;

a conversion and transmission mechanism converting a forward and backward motion of said main piston into a rotating and swinging motion of said output shaft so as to transmit to said output shaft; and a sub piston for restricting a middle stop position of said main piston, said sub piston having a stroke smaller than that of said main piston, a fluid pressure operating force larger than that of said main piston, and arranged within said casing in such a manner as to freely move in the forward and backward directions due to the fluid pressure and be capable of being brought into contact with said main piston;

wherein:

said conversion and transmission mechanism includes at least one of first converting means converting a forward and backward motion of said main piston into a rotating and swinging motion of said main piston and second converting means converting the forward and backward motion of said main piston into the rotating and swinging motion of said output shaft; and said first converting means is constituted by a spiral groove formed on an outer periphery of said main piston and a pin fitted to said casing so as to be fitted to said spiral groove, and said second converting means is constituted by a spiral groove formed on an outer periphery of said output shaft and a pin fixed to said main piston so as to be fitted to said spiral groove.

19. A swing actuator according to claim 18, wherein said swing actuator has an adjuster for changing the middle stop position of said main position by adjusting the stroke of said sub piston, and the adjuster is constituted by a bolt, has an outer end portion for an adjusting operation protruding outward from said casing and an inner end portion fitted to an inner portion of said sub piston in such a manner as to freely slide relatively and is provided with an engaging portion engaging with said sub piston in said inner end portion.

20. A three-position stop type swing actuator comprising:

a main piston arranged within a casing in such a manner as to freely move in forward and backward directions due to a fluid pressure;

an output shaft placed at a coaxial position with said main piston in such a manner as to be fixed in an axial direction and freely rotate around an axis;

a conversion and transmission mechanism converting a forward and backward motion of said main piston into a rotating and swinging motion of said output shaft so as to transmit to said output shaft; and a sub piston for restricting a middle stop position of said main piston, said sub piston having a stroke smaller than that of said main piston a fluid pressure operating force larger than that of said main piston, and arranged within said casing in such a manner as to freely move in the forward and backward directions due to the fluid pressure and be capable of being brought into contact with said main piston;

wherein:

said conversion and transmission mechanism includes at least one of first converting means converting a forward and backward motion of said main piston into a rotating and swinging motion of said main piston and second converting means converting the forward and backward motion of said main piston into the rotating and swinging motion of said output shaft; and said first converting means comprises a spiral groove formed on an outer periphery of said main piston and a pin fitted to said casing so as to be fitted to said at least one spiral groove, and said second converting means comprises a screw having a lead angle larger than 45 degrees and formed on the outer periphery of said output shaft, and a nut formed in the main piston and meshed with the screw.

21. A swing actuator according to claim 20, wherein said swing actuator has an adjuster for changing the middle stop position of said main piston by adjusting the stroke of said sub piston, and the adjuster is constituted by a bolt, has an outer end portion for an adjusting operation protruding outward from said casing and an inner end portion fitted to an inner portion of said sub piston in such a manner as to freely slide relatively and is provided with an engaging portion engaging with said sub piston in said inner end portion.

* * * * *